United States Patent [19]

Metrailer et al.

[11] 4,051,016

[45] Sept. 27, 1977

[54] FLUID COKING WITH $H_2S$ ADDITION

[75] Inventors: William J. Metrailer, Baton Rouge, La.; Charles Rebick, Mountainside; Richard K. Lyon, Fanwood, both of N.J.

[73] Assignee: Exxon Research & Engineering Co., Linden, N.J.

[21] Appl. No.: 652,761

[22] Filed: Jan. 27, 1976

[51] Int. Cl.[2] ..... C10G 9/32

[52] U.S. Cl. ..... 208/127; 201/31; 201/36; 208/8

[58] Field of Search ..... 208/8, 127; 201/31, 201/36

[56] References Cited

U.S. PATENT DOCUMENTS

| | | | |
|---|---|---|---|
| 2,894,897 | 7/1959 | Post | 208/127 |
| 2,895,896 | 7/1959 | Ploeg | 208/127 |
| 3,481,834 | 12/1969 | Squires | 208/127 |
| 3,707,462 | 12/1972 | Moss | 208/127 |
| 3,853,744 | 12/1974 | Lahn | 208/127 |

*Primary Examiner*—Herbert Levine
*Attorney, Agent, or Firm*—Marthe L. Gibbons

[57] ABSTRACT

A fluid coking process is provided in which a relatively large amount of hydrogen sulfide is added to the coker fluidizing gas. A preferred fluidizing gas is a mixture of hydrogen and hydrogen sulfide.

9 Claims, 1 Drawing Figure

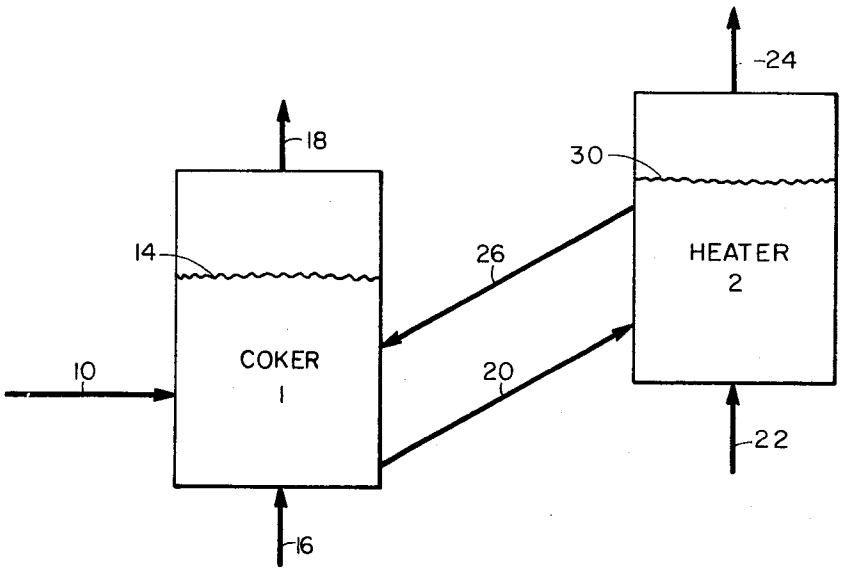
HEATER
2
COKER
1
24
22
30
26
20
18
16
14
10

FLUID COKING WITH $H_2S$ ADDITION

BACKGROUND OF THE INVENTION

1. Field of the Invention

This invention relates to an improvement in a fluid coking process. More particularly, this invention relates to a fluid coking process in which hydrogen sulfide is added to the fluidizing gas.

2. Description of the Prior Art

Fluid coking is a well known process which may be carried out with or without recycle of the heavier portion of the fluid coking zone effluent. As is well known in the art, the fluid coking process, shown, for example, in U.S. Pat. No. 2,881,130, which is hereby incorporated by reference, uses a fluid coking vessel and external heating vessel. A fluid bed of solids, preferably coke particles produced by the process having a size in the range from about 40 to about 1000 microns is maintained in the coking zone by the upward passage of fluidizing gas, usually steam, injected at a superficial velocity usually between 0.3 and 5 feet per second. The temperature in the fluid coking bed is maintained in the range of from about 850° to about 1200° F., preferably between 900° and 1100° F. by circulating solids (coke) to the heating vessel and back. The heavy oil to be converted is injected into the fluid bed and upon contact with the hot solids undergoes pyrolysis evolving lighter hydrocarbon products in vapor phase, including normally liquid hydrocarbons, and depositing a carbonaceous residue (coke) on the solids. The turbulence of the fluid bed normally results in substantially isothermal reaction conditions and thorough and rapid distribution of the heavy injected oil. Product vapors, after removal of entrained solids, are withdrawn overhead from the coking zone and sent to a scrubber and fractionator for cooling and separation. The end boiling point of the distillate fraction obtained from the process is usually 1,050° to 1,200° F. and the remaining heavy ends are usually recycled to extinction.

U.S. Pat. No. 3,848,017 discloses thermal cracking of vaporized normally liquid hydrocarbons comprisng added hydrogen sulfide.

U.S. Pat. No. 3,853,744 discloses the use of sour steam containing minor amounts of hydrogen sulfide as fluidizing gas for a fluid coking bed.

U.S. Pat. Nos. 2,888,395 and 2,888,393 disclose fluid coking with added hydrogen.

It is also known to utilize light hydrocarbons to supplement or be used as fluidizing gas in fluid coking as shown in U.S. Pat. Nos. 2,636,844; 2,734,852 and 2,863,823.

It has now been found that the addition of a relatively large amount of hydrogen sulfide to the fluidizing gas of the coker will result in advantages that will become apparent in the ensuing description.

SUMMARY OF THE INVENTION

In accordance with the invention there is provided, in a fluid coking process comprising the steps of contactng a carbonaceous material having a Conradson carbon content of at least 5 weight percent with hot fluidized solids in a fluidized coking bed contained in a coking zone maintained in a fluidized state by the introduction of a fluidizing gas and operated at coking conditions to produce a vapor phase product and a solid carbonaceous material which deposits on said fluidized solids, the improvement which comprises conducting said fluid coking process in the presence of added hydrogen sulfide, said hydrogen sulfide being added in an amount sufficient to comprise at least 5 mole percent of said fluidizing gas.

BRIEF DESCRIPTION OF THE DRAWING

The FIGURE is a schematic flow plan of one embodiment of the invention.

DESCRIPTION OF THE PREFERRED EMBODIMENT

The preferred embodiment will be described with reference to the FIGURE.

Referring to the FIGURE, a carbonaceous material having a Conradson carbon content of at least 5 weight percent is passed by line 10 into a coking zone 1 in which is maintained a fluidized bed of solids (e.g. coke particles of 40 to 1000 microns in size) having an upper level indicated at 14. Suitable carbonaceous feeds for the present invention include heavy hydrocarbonaceous oils; heavy and reduced petroleum crudes; atmospheric residuum; vacuum residuum; pitch; asphalt; bitumen; other heavy hydrocarbon residues; coal; coal slurry; liquid products derived from coal liquefaction processes and mixtures thereof. Typically such feeds have a API gravity of about −10° to +20° and a Conradson carbon content of at least 5 weight percent, generally from about 5 to about 50 weight percent, preferably above 7 weight percent (as to Conradson carbon residue, see ASTM test D-189-65). A fluidizing gas is admitted into coking reactor 1 by line 16 in an amount sufficient to maintain a superficial gas velocity in the range of about 0.5 to about 5 feet per second. The fluidizing gas introduced into the coking reactor comprises at least 5 mole percent hydrogen sulfide, preferably from about 5 to about 40 mole percent hydrogen sulfide, more preferably from about 10 to about 30 mole percent hydrogen sulfide and may also comprise hydrogen, steam, gaseous hydrocarbons, vaporized normally liquid hydrocarbons or mixtures thereof. The hydrogen sulfide may be introduced into the coking reactor as essentially pure $H_2S$ or refinery off-gases containing $H_2S$ or any other suitable gas mixture containing $H_2S$ as a constituent. If desired, at least a portion of the required amount of $H_2S$ may be introduced in a solution from which it can be vaporized. Preferably the fluidizing gas mixture utilized in the present invention consists essentially of hydrogen and hydrogen sulfide. Suitable mixtures of hydrogen and hydrogen sulfide would include mixtures containing at least 5 mole percent hydrogen sulfide and at least 30 mole percent hydrogen, preferably at least 40 mole percent hydrogen. The hydrogen utilized may be pure hydrogen but will generally be a hydrogen stream containing some other gaseous contaminants, for example, the hydrogen-containing effluent produced in reforming processes, etc. Coke at a temperature above the coking temperature, for example, at a temperature from about 100° to 800° F. in excess of the actual operating temperature of the coking zone is admitted to coker 1 by line 26 in an amount sufficient to maintain the coking temperature in the range of about 850° to about 1,200° F., preferably in the range of about 950° to about 1,100° F. The pressure in the coking zone is maintained in the range of about 0 to about 150 pounds per square inch gauge (psig), preferably in the range of about 5 to about 45 psig. The lower portion of the coking reactor serves as a stripping zone to remove occluded hydrocarbons from the solids. A stream of solids is withdrawn from the stripping zone by line 20 and circulated to heater 2. A vapor phase reaction product is removed overhead by line 18. The vaporous product includes gaseous hydrocarbons and normally liquid hydrocarbons, hydrogen sulfide which is produced during the coking operation, as well as hydrogen sulfide and other gases which are introduced into the coking reactor as fluidizing gas. The vapor phase product is removed from coker 1 by line 18 for scrubbing and fractionation in a conventional way. If desired, at least a portion of the vaporous effluent comprising hydrogen sulfide may be recycled to the coker. Additional amounts of hydrogen sulfide or other gases will then be added to the recycle stream to adjust the hydrogen sulfide concentration to be within the desired range. The portion of the effluent recycled to the coker may comprise only the light gases or the recycle portion may include vaporized normally liquid hydrocarbons such as the naphtha fraction. A stream of heavy material condensed from the vaporous coker effluent may be recycled to the coker, or the coker may be operated in a once-through manner, that is, without recycle of the heavy material to the coker.

A stream of stripped coke (commonly called cold coke) is withdrawn from the coker by line 20 and introduced to a fluid bed of hot coke having a level 30 in heater 2. The heater can be operated as a conventional coke burner such as disclosed in U.S. Pat. No. 2,881,130, which is hereby incorporated by reference. When the heater is operated as a burner, an oxygen-containing gas, typically air, is introduced into the heater 2 by line 22. The combustion of a portion of the solid carbonaceous deposition on the solid with the oxygen-containing gas provides the heat required to heat the colder particles. The temperature in the heating zone (burning zone) is maintained in the range of about 1,200° to about 1,700° F. Alternatively, heater 2 could be operated as a heat exchange zone such as disclosed in U.S. Pat. Nos. 3,661,543; 3,702,516; and 3,759,676, the teachings of which are hereby incorporated by reference. Hot coke is removed from the fluidized bed in heater 2 and recycled to the coking reactor by line 26 to supply the heat thereto.

While the process has been described for simplicity of description with respect to circulating coke as the fluidized solids, it is to be understood that the fluidized seed particles on which the coke is deposited may be silica, alumina, zirconia, magnesia, calcium oxide, alundum, mullite, bauxite or the like.

The following example is presented to illustrate the invention.

EXAMPLE

Several runs were made in a coking unit containing a stirred fluid bed of solids (mullite) under conditions to simulate the fluid coking zone of the process of the present invention. Various gases or gaseous mixtures were introduced into the coking unit together with the residuum feed to simulate a fluidized coking reaction. The feed utilized in these runs was a Tia Juana vacuum residuum having a Conradson carbon of 20.66 and an API gravity of 7.7. The products were recovered and analyzed by conventional methods. The feedstock characteristics, operating conditions, product yield and quality are summarized in the Table.

As can be seen from the Table, runs 2 and 3, which are runs in accordance with the present invention, showed advantages over runs 1 and 4 which are runs carried out without the addition of $H_2S$. In runs 2 and 3, there was a large increase in the degree of saturation of light gases, a substantial decrease in unsaturation of the naphtha fraction as measured by FIA and by bromine number and a decrease of unsaturation in the 430/975 fraction, as shown by the bromine number. Since unsaturation is undesirable for certain uses of the products, the decrease in unsaturation represents an upgrading of the coker products relative to conventional coker products. Furthermore, since coker products are usually subjected to a subsequent hydrotreating process to upgrade them, the decrease of unsaturation of the coker products of the present invention will mean that less hydrogen will be required in the subsequent hydrotreating stage.

TABLE

| Run No. | 1 | 2 | 3 | 4 |
|---|---|---|---|---|
| Conditions: | | | | |
| Temp., ° F. | 958 | 953 | 953 | 956 |
| Pressure, psig | 10 | 10 | 10 | 10 |
| Equivalent Sec. at 950° F. | 14.0 | 12.0 | 12.5 | 12.6 |
| Fluidizing Gas | $H_2$ | $H_2/H_2S$ | $H_2O/H_2S$ | $H_2O$ |
| Mole % $H_2S$ in Fluidizing Gas | 0 | 20 | 20 | 0 |
| Product Yield[1]: | | | | |
| $H_2$–$C_5$ | 10.0 | 7.5 | 8.7 | 8.3 |
| $C_6$/430 | 9.7 | 10.8 | 10.5 | 9.8 |
| 430/975 | 37.8 | 40.1 | 37.4 | 37.3 |
| 975 + | 21.0 | 20.7 | 22.3 | 25.5 |
| Coke | 21.0 | 20.6 | 21.0 | 18.6 |
| PRODUCT QUALITY: | | | | |
| Gas Saturation | | | | |
| $C_2H_6/C_2H_4$ molar ratio | 2.33 | 3.21 | 2.91 | 2.13 |
| $C_3H_8/C_3H_6$ molar ratio | 1.02 | 1.32 | 1.22 | 0.93 |
| $C_4/C_4$= | 0.61 | 0.84 | 0.82 | 0.58 |
| Naphtha | | | | |
| Bromine #% | 96.5 | 78.9 | 79.8 | 85.7 |
| FIA[2] aromatics | 23.9 | 13.2 | 27.5 | 19.9 |
| FIA[2] unsats | 47.9 | 52.7 | 46.3 | 56.6 |
| FIA[2] paraffins | 28.2 | 32.1 | 26.2 | 23.5 |
| Aniline PT ° F | 89.0 | 91.5 | 88.5 | 86.0 |
| Gravity (° API) | 52.3 | 53.2 | 52.2 | 54.1 |
| 430/650 | | | | |
| Bromine # | 51.0 | 36.2 | 33.5 | 41.1 |
| Gravity (° API) | 32.9 | 30.1 | 30.3 | 28.5 |
| 650/975 | | | | |
| Con Carbon wt. % | 1.5 | 1.75 | 1.68 | 1.80 |
| Gravity(° API) | 17.0 | 15.9 | 15.7 | 14.8 |
| 975 + | | | | |
| Con Carbon | 16.61 | 14.77 | 16.73 | 15.22 |
| Gravity (° API) | 9.3 | 8.5 | 8.2 | 9.9 |

[1]Total product basis for once-through operation, corrected for distillation end points.
[2]FIA = Fluorescent indicator analysis

What is claimed is:

1. In a fluid coking process comprising the steps of contacting a carbonaceous material having a Conradson carbon content of at least 5 weight percent with hot fluidized solids in a fluidized coking bed contained in a coking zone maintained in a fluidized state by the introduction of a fluidizing gas and operated at coking conditions, including a pressure ranging from about 0 to about 150 psig, to produce a vapor phase product and a solid carbonaceous material which deposits on said fluidized solids, the improvement which comprises introducing into said coking zone a fluidizing gas comprising from about 5 to about 40 mole percent of hydrogen sulfide, based on the total gas introduced into said coking zone.

2. The process of claim 1 wherein said hydrogen sulfide comprises from about 10 to about 30 mole percent of said fluidizing gas.

3. The process of claim 1 wherein said fluidizing gas also comprises a member selected from the group consisting of steam, vaporized hydrocarbons, hydrogen, and mixtures thereof.

4. The process of claim 1 wherein said fluidizing gas comprises at least 30 mole percent hydrogen.

5. The process of claim 1 wherein said fluidizing gas comprises at least 40 mole percent hydrogen.

6. The process of claim 1 wherein at least a portion of said hydrogen sulfide is introduced into said coking zone in gaseous form.

7. The process of claim 1 wherein at least a portion of said hydrogen sulfide is introduced into said coking zone in a solution from which it is vaporized in situ.

8. The process of claim 1 wherein said coking conditions include a temperature ranging from about 850° to about 1200° F.

9. The process of claim 1 wherein said coking conditions include a temperature ranging from about 950° to about 1100° F.

* * * * *